US010827270B2

(12) United States Patent
Kawai

(10) Patent No.: US 10,827,270 B2
(45) Date of Patent: Nov. 3, 2020

(54) SIGNAL PROCESSING DEVICE

(71) Applicant: YAMAHA CORPORATION, Hamamatsu-shi (JP)

(72) Inventor: Hironari Kawai, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 16/574,482

(22) Filed: Sep. 18, 2019

(65) Prior Publication Data

US 2020/0015013 A1 Jan. 9, 2020

Related U.S. Application Data

(63) Continuation of application No. PCT/JP2017/011325, filed on Mar. 22, 2017.

(51) Int. Cl.
*H04R 5/04* (2006.01)
*H04S 7/00* (2006.01)
*H04R 3/12* (2006.01)

(52) U.S. Cl.
CPC ..... *H04R 5/04* (2013.01); *H04R 3/12* (2013.01); *H04S 7/30* (2013.01)

(58) Field of Classification Search
None
See application file for complete search history.

(56) References Cited

U.S. PATENT DOCUMENTS 6,766,025 B1 7/2004 Levy
2005/0135631 A1* 6/2005 Yoshino ..... H04S 7/301 381/59
2007/0086597 A1* 4/2007 Kino ..... H04S 7/301 381/59
2011/0299706 A1* 12/2011 Sakai ..... H04S 7/301 381/303
2013/0058492 A1* 3/2013 Silzle ..... H04R 3/005 381/59

(Continued)

FOREIGN PATENT DOCUMENTS

JP H05344600 A 12/1993
JP H10136498 A 5/1998

(Continued)

OTHER PUBLICATIONS

International Search Report issued in Intl. Appln. No. PCT/JP2017/011325 dated Jun. 13, 2017. English translation provided.

(Continued)

*Primary Examiner* — Paul W Huber
(74) *Attorney, Agent, or Firm* — Rossi, Kimms & McDowell LLP

(57) ABSTRACT

A signal processing device includes a switching receptor, a storage, and a signal processor. The switching receptor receives switching of a speaker serving as a supply destination of a signal. The storage stores an optimal setting, which is obtained by measuring characteristics of the speaker selected by the switching, in association with the switching of the speaker. The signal processor reads out the optimal setting, which is associated with the switching received by the switching receptor, from the storage, and uses the optimal setting to process the signal to be supplied to the speaker.

5 Claims, 10 Drawing Sheets

(56) References Cited

U.S. PATENT DOCUMENTS

| | | | | |
|---|---|---|---|---|
| 2013/0163770 | A1* | 6/2013 | Takemura | H04R 3/14 381/59 |
| 2014/0064492 | A1* | 3/2014 | Lakkundi | G06F 3/165 381/17 |
| 2016/0049914 | A1* | 2/2016 | Choi | H03G 3/20 381/104 |

FOREIGN PATENT DOCUMENTS

| | | | |
|---|---|---|---|
| JP | 2002539738 | A | 11/2002 |
| JP | 2004096515 | A | 3/2004 |
| JP | 2008306348 | A | 12/2008 |
| JP | 2009130642 | A | 6/2009 |
| JP | 2015084584 | A | 4/2015 |

OTHER PUBLICATIONS

Written Opinion issued in Intl. Appln. No. PCT/JP2017/011325 dated Jun. 13, 2017.
Office Action issued in Japanese Appln. No. 2019-506591 dated Feb. 25, 2020. English translation provided.

* cited by examiner

SIGNAL PROCESSING DEVICE

CROSS REFERENCE TO RELATED APPLICATIONS

The present application is a continuation of International Application No. PCT/JP2017/011325, filed on Mar. 22, 2017, the entire contents of which is incorporated herein by reference.

BACKGROUND OF THE INVENTION

1. Field of the Invention

A preferred embodiment of the present invention relates to a technology for processing a signal to be supplied to a speaker.

2. Description of the Related Art

An AV (Audio Visual) amplifier may reproduce sound using all speakers connected to the amplifier. In addition, a HiFi (Hi Fidelity) amplifier may be able to use a speaker by switching speakers according to a sound source (classic or rock, for example) to be reproduced. Then, various methods have been proposed as technology to measure speaker characteristics and optimize the speaker characteristics using a measurement result (see Unexamined Japanese Patent Publication No. 2015-84584, for example).

However, even when the optimization technology in Patent Literature 1 or the like is merely applied to an amplifier capable of switching speakers, a user will need to, for example, call a measurement result or to remeasure speaker characteristics after the speaker is switched, thereby forcing complicate operations on the user.

SUMMARY

A signal processing device according to a preferred embodiment of the present invention includes a switching receptor, a storage, and a signal processor. The switching receptor receives switching of a speaker serving as a supply destination of a signal. The storage stores an optimal setting, which is obtained by measuring characteristics (speaker characteristics) of the speaker selected by the switching, in association with the switching of the speaker. The signal processor reads out the optimal setting, which is associated with the switching received by the switching receptor, from the storage, and uses the optimal setting to process the signal to be supplied to the speaker.

DETAILED DESCRIPTION OF THE PREFERRED EMBODIMENTS

[1]First Preferred Embodiment

[1-1] Configuration of Signal Processing Device

Figure 1:
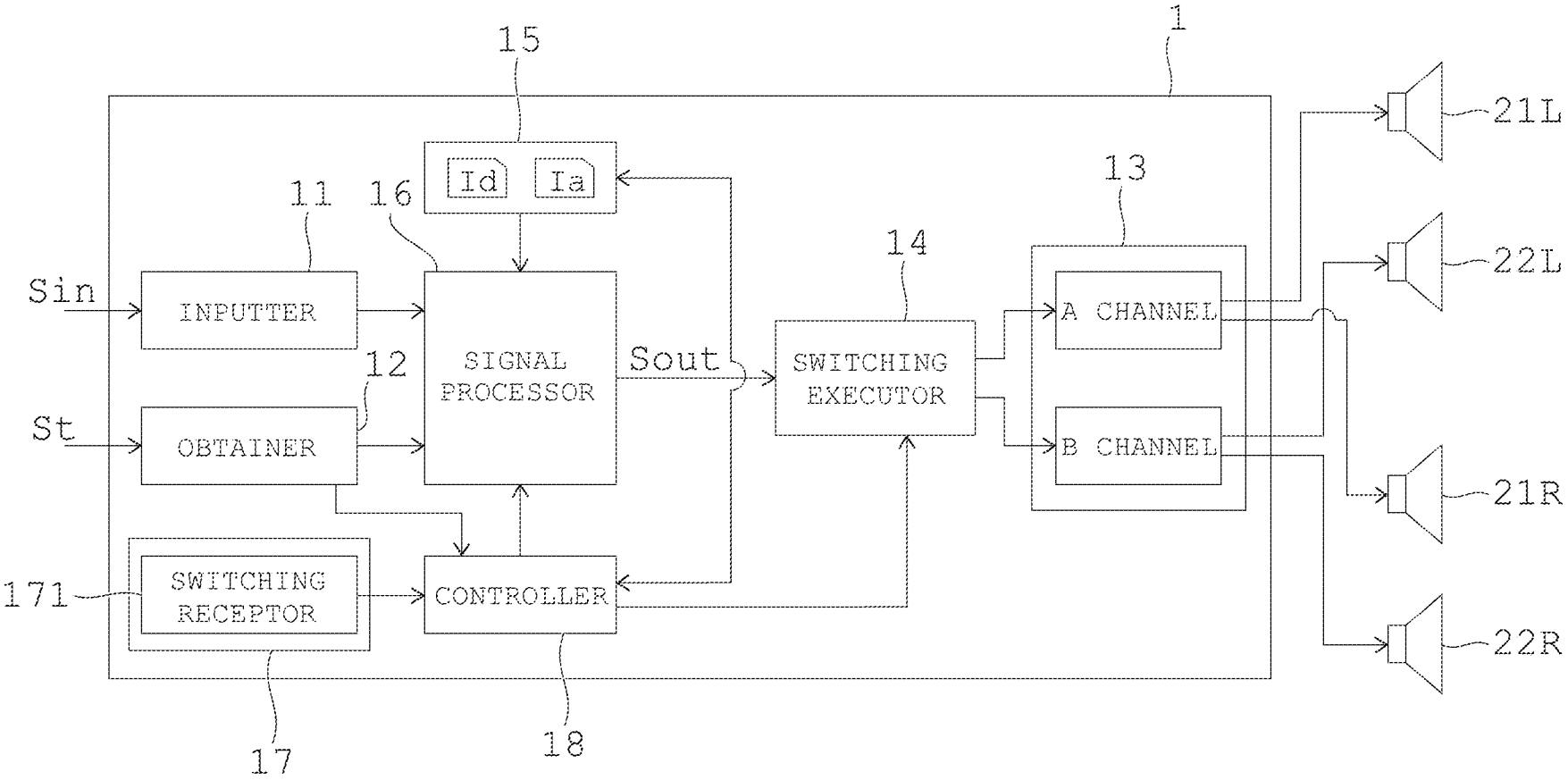
FIG. 1 is a block diagram conceptually showing a configuration of a signal processing device in accordance with a first preferred embodiment.
Figure 2:
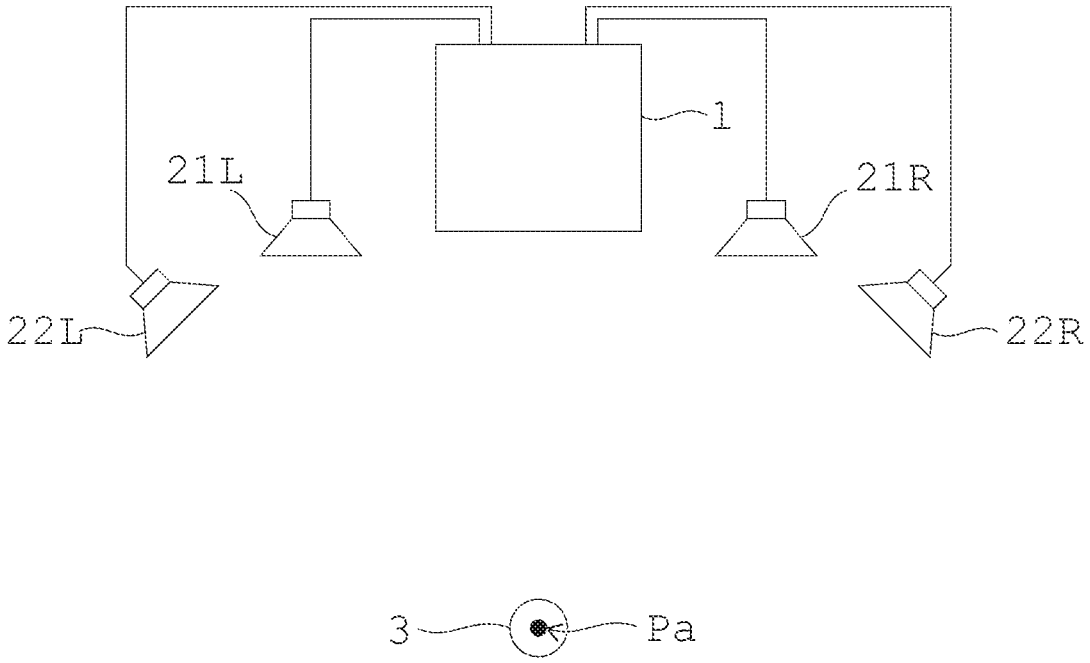
FIG. 2 is a conceptual diagram showing an application example of the signal processing device.

FIG. 1 is a block diagram conceptually showing a configuration of a signal processing device 1 in accordance with a first preferred embodiment. Further, FIG. 2 is a conceptual diagram showing an application example of the signal processing device 1. As shown in FIG. 1, the signal processing device 1 includes an inputter 11, an obtainer 12, an outputter 13, a switching executor 14, a storage 15, a signal processor 16, an operation receptor 17, and a controller 18 that controls these components collectively.

The inputter 11 is an interface used for inputting an audio signal to the signal processing device 1. Herein, the audio signal to be inputted to the signal processing device 1 is an audio signal that is inputted from reading devices (not shown) such as a CD player, a DVD player, and an LD player. Hereinafter, the audio signal is referred to as "input audio signal Sin."

Specifically, the inputter 11 has an interface that receives input of a digital audio signal, such as a HDMI (registered trademark) (High-Definition Multimedia Interface) or an S/PDIF (Sony Philips Digital Interface). A CD player or the like is connected to the interface. The inputter 11 further has an interface that receives input of an analog audio signal. An LD player or the like is connected to the interface. Note that, the inputter 11 may contain an ADC (Analog to Digital Converter) that converts the inputted analog audio signal into a digital signal.

The obtainer 12 is an interface that receives input of a sound signal to the signal processing device 1. A microphone 3 (see FIG. 2) is connected to the obtainer 12. A sound, which is inputted to the microphone 3, is converted into a sound signal in the microphone 3, and inputted to the obtainer 12. Note that, the sound signal may be an analog signal or may be a digital signal. In the case where the sound signal is an analog signal, the obtainer 12 may contain an ADC that converts the sound signal into a digital signal.

The outputter 13 is an interface used for outputting the audio signal to a speaker. Herein, the audio signal, which is outputted to the speaker, is an audio signal that is subjected to signal processing in the signal processor 16, as described later. Hereinafter, this audio signal is referred to as "output audio signal Sout."

In the present preferred embodiment, the outputter 13 includes an A-channel and a B-channel as an output channel to which the speaker is connected. As an example, a pair of speakers 21L and 21R are connected to the A-channel, and a pair of speakers 22L and 22R are connected to the B-channel.

The switching executor 14 is a switch circuit, for example. The switching executor 14 switches to select one or both of the A-channel and the B-channel to be connected to the signal processor 16, according to a switching execution instruction from the controller 18. Specifically, in the switching executor 14, it is possible to execute switching to select only the A-channel, switching to select only the B-channel, and switching to select both the A-channel and the B-channel.

The operation receptor 17 is a user interface for receiving an operation instruction from a user. In the present preferred embodiment, the operation receptor 17 includes a switching receptor 171 that receives input of a switching instruction for switching the speaker from a user. The switching receptor 171 is, for example, a changeover switch of a multi-stage type or a switching dial. Note that, the operation receptor 17 may include a display for presenting various information to a user. Further, the operation receptor 17 may include a receptor that receives an operation signal from mobile terminals, such as a remote controller and a smart phone. The operation receptor 17 may receive the operation signal, which is received by the receptor, as an operation instruction.

When only the A-channel is selected, only a pair of speakers 21L and 21R, which are connected to the A-channel, are used as a supply destination of the output audio signal Sout. When only the B-channel is selected, only a pair of speakers 22L and 22R, which are connected to the B-channel, are used as a supply destination of the output audio signal Sout. When both the A-channel and the B-channel are selected, all of the speakers 21L, 21R, 22L, and 22R, which are connected to these channels, are used as a supply destination of the output audio signal Sout.

In other words, the speaker serving as a supply destination of the output audio signal Sout is switched by the switching executor 14, according to the switching instruction received by the switching receptor 171. Such switching of the speaker includes a concept of an increase or decrease in the number of speakers.

Note that, the switching executor 14 is not limited to a switch circuit, but may be an executor of the controller 18, which internally executes the switching (switch an output channel) of a speaker according to the switching instruction from a user. Such an executor can also be applied to the case where the output audio signal Sout is supplied to the speaker wirelessly from the signal processing device 1.

The storage 15 stores, as data, a default setting Id for achieving default signal processing. For instance, the default setting Id includes a setting for equalizing a left and right balance of the speaker, a setting for flattening frequency characteristics (F characteristics), and the like. As an example, the default setting Id includes various kinds of settings (setting of successive model specifications) that have been used without being greatly changed from successive models of amplifiers or the like.

The storage 15 further stores the optimal setting Ia as data, in association with the switching (only the A-channel, only the B-channel, the A-channel+the B-channel) of the speaker. Herein, the optimal setting Ia corresponds to a measurement result obtained by measuring characteristics (speaker characteristics) of the speaker selected by the switching of the speaker. Specifically, the optimal setting Ia includes various kinds of settings (a setting of frequency characteristics (F characteristics), a setting of output timing (delay), a setting of a volume level, and the like) for optimizing the characteristics of the speaker according to the switching of the speaker. Note that, the signal processing device 1 performs the following processing to obtain the optimal setting Ia.

Figure 3:
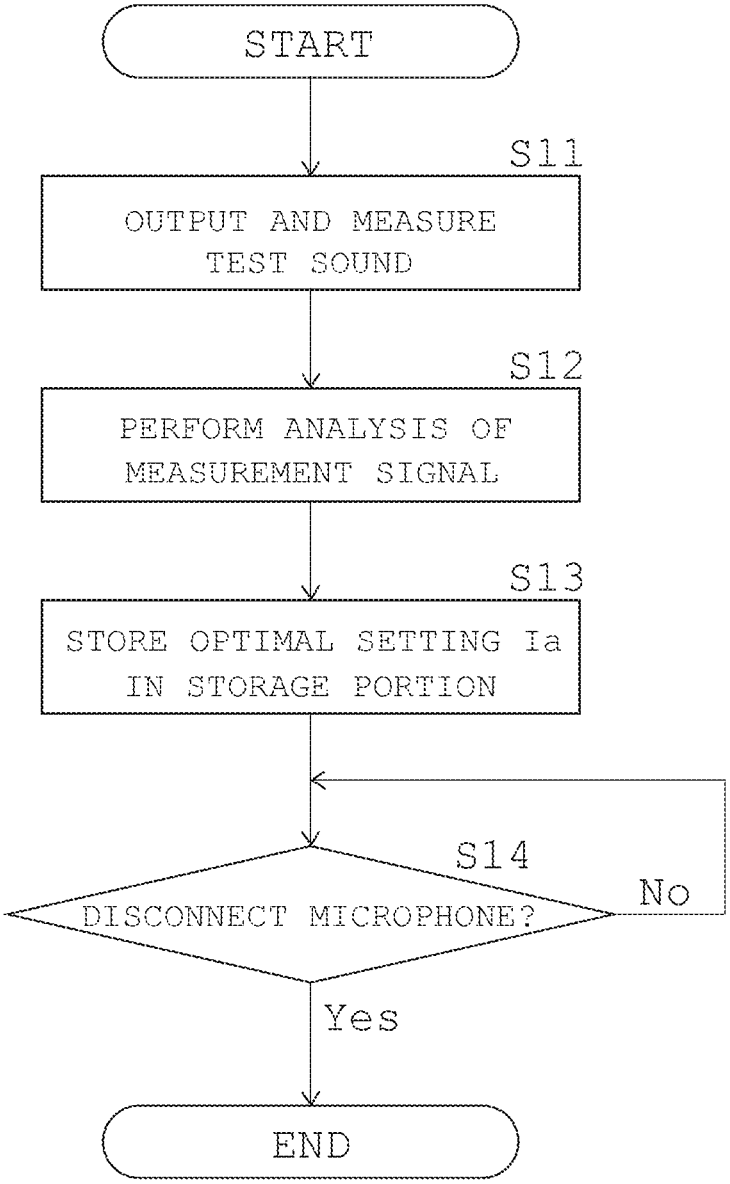
FIG. 3 is a flowchart showing processing to obtain an optimal setting, which is performed in the signal processing device.

FIG. 3 is a flowchart showing processing for obtaining the optimal setting Ia. When the signal processing device 1 detects that the microphone 3 has been connected to the obtainer 12, or when an instruction of starting the measurement is received from a user, the processing is started. At this time, the microphone 3 is installed at a listening position Pa by a user (see FIG. 2). After the control processing is started, the signal processing device 1 measures a test sound at the listening position Pa by using the microphone 3, while emitting the test sound from the speaker selected by the switching of the speaker (Step S11). Next, the signal processing device 1 analyzes the signal, which is obtained through the measurement, to derive various kinds of settings for optimizing the speaker characteristics (Step S12). Subsequently, by the signal processing device 1, the various kinds of settings, which are derived at Step S12, are stored in the storage 15 as the optimal setting Ia (Step S13). After that, when the signal processing device 1 detects that the microphone 3 has been removed from the obtainer 12 (Step S14), the processing for obtaining the optimal setting Ia is completed. Note that, the processing may be completed when this processing is performed for all switching operations and the optimal setting Ia corresponding to each switching is completely acquired.

The signal processor 16 is a DSP (Digital Signal Processor) for example, and selectively reads out data related to any one of the default setting Id and the optimal setting Ia from the storage 15 according to a read-out execution instruction from the control portion 18. Then, the signal processor 16 performs signal processing of the input audio signal Sin, using the read-out data.

If the default setting Id is used to process the input audio signal Sin, an output audio signal Sout on which the various kinds of settings in the default setting Id are reflected is obtained. This output audio signal Sout is supplied to the speaker, so that a default sound is outputted. Further, if the optimal setting Ia is used to process the input audio signal Sin, an output audio signal Sout on which the various kinds of settings in the optimal setting Ia are reflected is obtained. This output audio signal Sout is supplied to the speaker, so that an optimized sound is outputted.

The controller 18, which controls the signal processing device 1 collectively, is constituted by processing units such as a CPU (Central Processing Unit) and a microcomputer. In the present preferred embodiment, the controller 18 performs various kinds of processing, according to the operation instruction received by the operation receptor 17, or the like. Note that, the processing performed by the controller 18 is achieved by executing a program corresponding thereto through the controller 18. Such a program may be stored in a readable storage medium (e.g., a flash memory or the like), or may be stored in the storage 15.

[1-2] Control in Signal Processing Device

Figure 4:
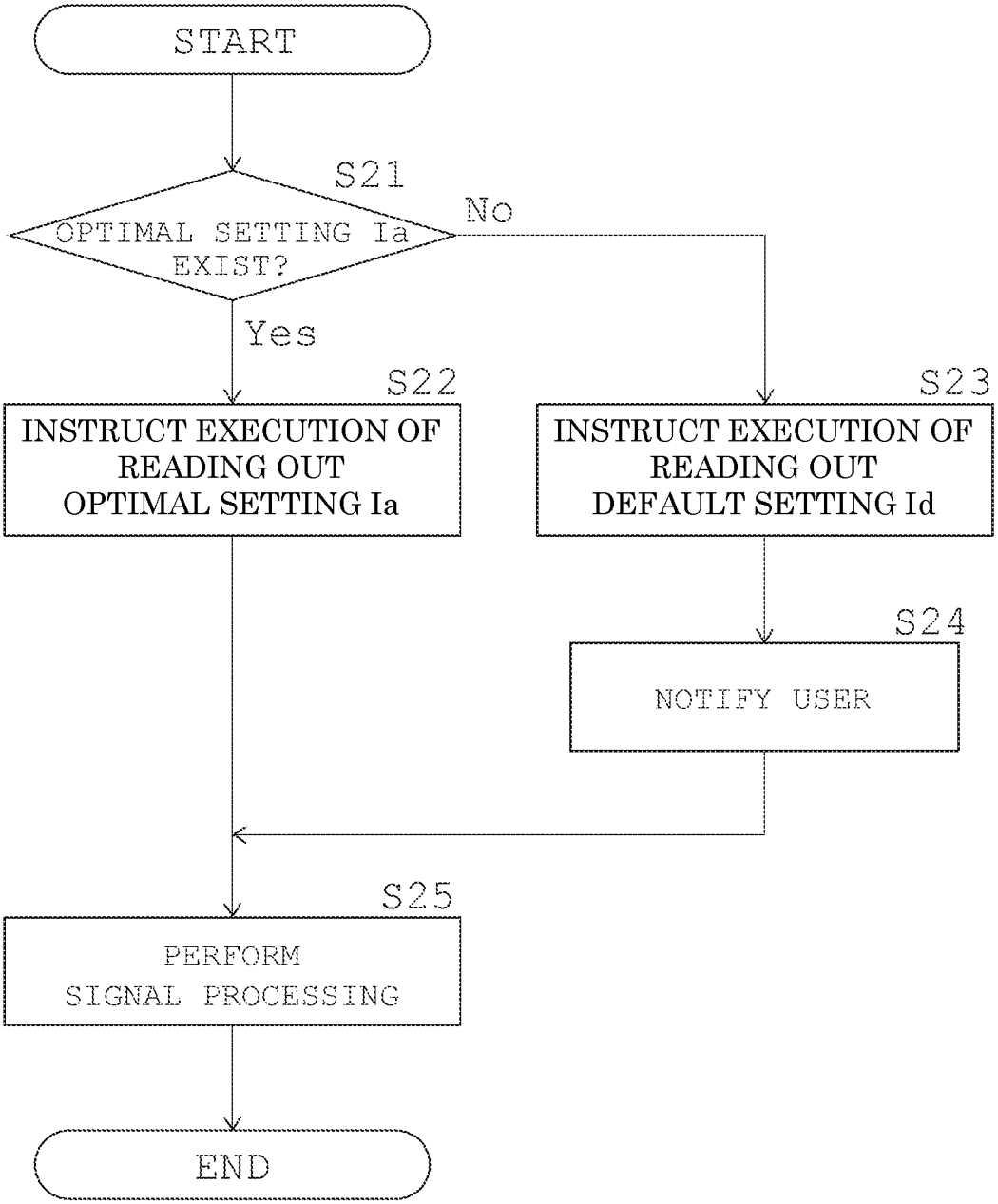
FIG. 4 is a flowchart showing reproduction processing performed in the signal processing device.

FIG. 4 is a flowchart showing reproduction processing performed in the signal processing device 1. The reproduction processing is started when electric power is supplied to the signal processing device 1 (at the time of power on), when the microphone 3 is disconnected to the obtainer 12, when the switching of the speaker is performed, and the like. Note that, if electric power is supplied to the signal processing device 1 in the state where the microphone 3 is connected to the obtainer 12, the processing for obtaining the above-mentioned optimal setting Ia may be performed before the reproduction processing is performed.

When the reproduction processing is started, the controller 18 determines whether the optimal setting Ia associated with the switching received by the switching reception portion 171 exists in the storage 15 or not (Step S21). When determining "exist (Yes)" at Step S21, the controller 18 causes the signal processor 16 to read out the optimal setting Ia associated with the switching received by the switching receptor 171, from the storage 15 (Step S22). On the other hand, when determining "not exist (No)" at Step S21, the controller 18 causes the signal processor 16 to read out the default setting Id (Step S23). In that time, the controller 18 performs processing of notifying a user that the optimal setting Ia associated therewith does not exist in the storage 15 (Step S24).

Next, the signal processor 16 performs signal processing of an input audio signal Sin to be inputted (Step S25). Specifically, the signal processor 16 performs the signal processing of the input audio signal Sin, using the data (default setting Id or optimal setting Ia) which has been already read out from storage portion 15. The output audio signal Sout obtained by performing the signal processing is supplied to an output channel connected via the switching executor 14, as necessary.

According to such reproduction processing, in each switching of the speaker allowed to be received by the switching receptor 171, once the corresponding optimal setting Ia is obtained (see FIG. 3), the controller 18 causes the signal processor 16 to perform signal processing by using the same optimal setting Ia stored in the storage 15, unless a change instruction (in the present preferred embodiment, connection of the microphone 3 to the obtainer 12) for changing the optimal setting Ia or the like is received. Therefore, the characteristics (speaker characteristics) of the speaker selected by the switching can be optimized automatically, according to the switching of the speaker.

In this way, in the signal processing device 1 of the present preferred embodiment, the optimal setting Ia obtained through the measurement channel can be preserved (stored in the storage 15) and called (read out from the storage 15) automatically. Therefore, complicated operations for optimizing the speaker characteristics can be eliminated when the speaker is switched.

[1-3] Another Application Example of Signal Processing Device

Figure 5:
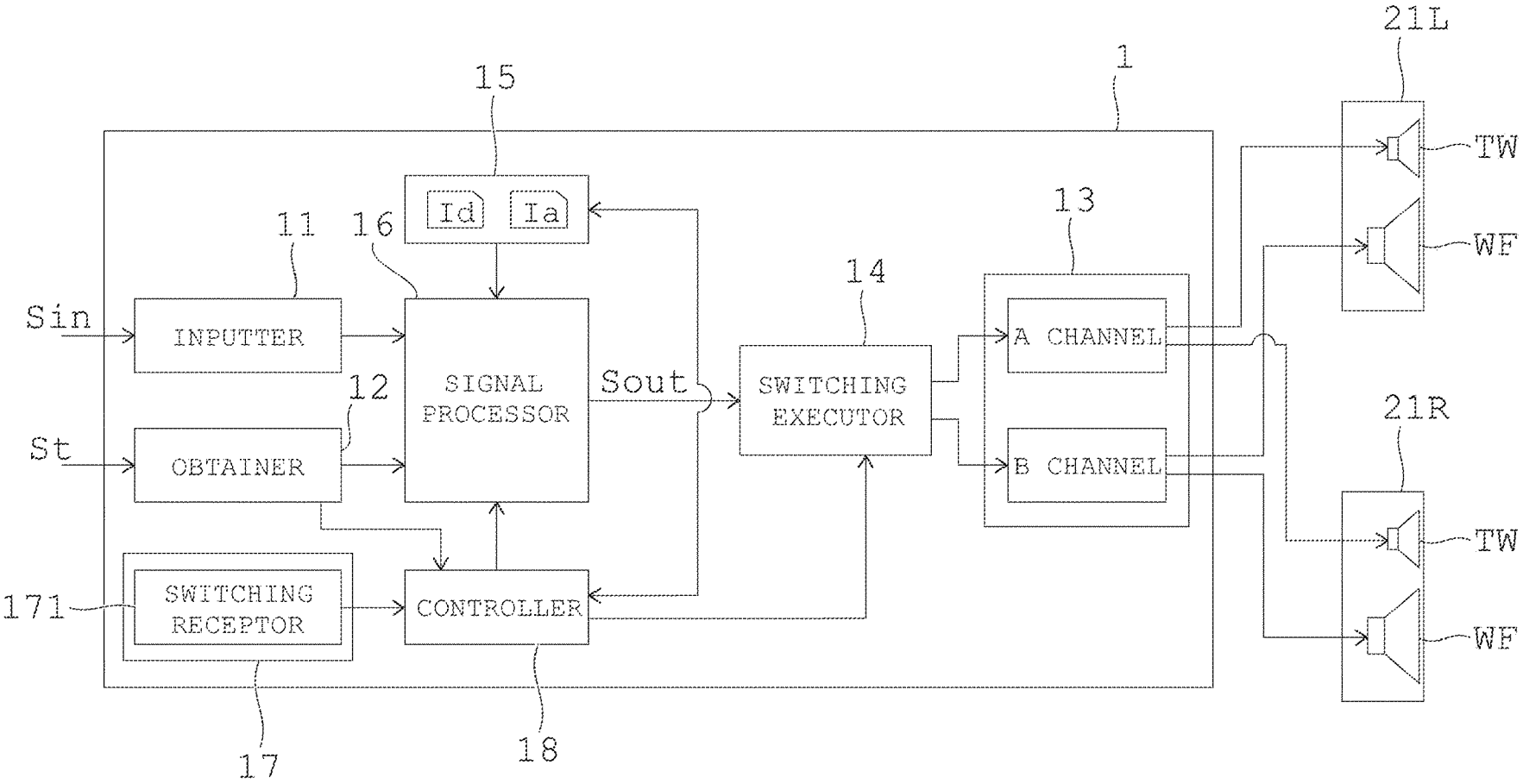
FIG. 5 is a block diagram showing another application example of the signal processing device.

FIG. 5 is a block diagram showing another application example of the signal processing device 1. As shown in FIG. 5, each of speakers 21L and 21R includes a tweeter TW serving as a speaker for high pitched sounds, and a woofer WF serving as a speaker for low pitched sounds. The tweeter TW and the woofer WF may be connected to the signal processing device 1, using a bi-wiring method. FIG. 5 shows the case where the tweeter TW is connected to the A-channel, and the woofer WF is connected to the B-channel. Switching of the speaker using such a bi-wiring method is also included in one aspect of the switching of the speaker in the present invention.

[2] Second Preferred Embodiment

Figure 6:
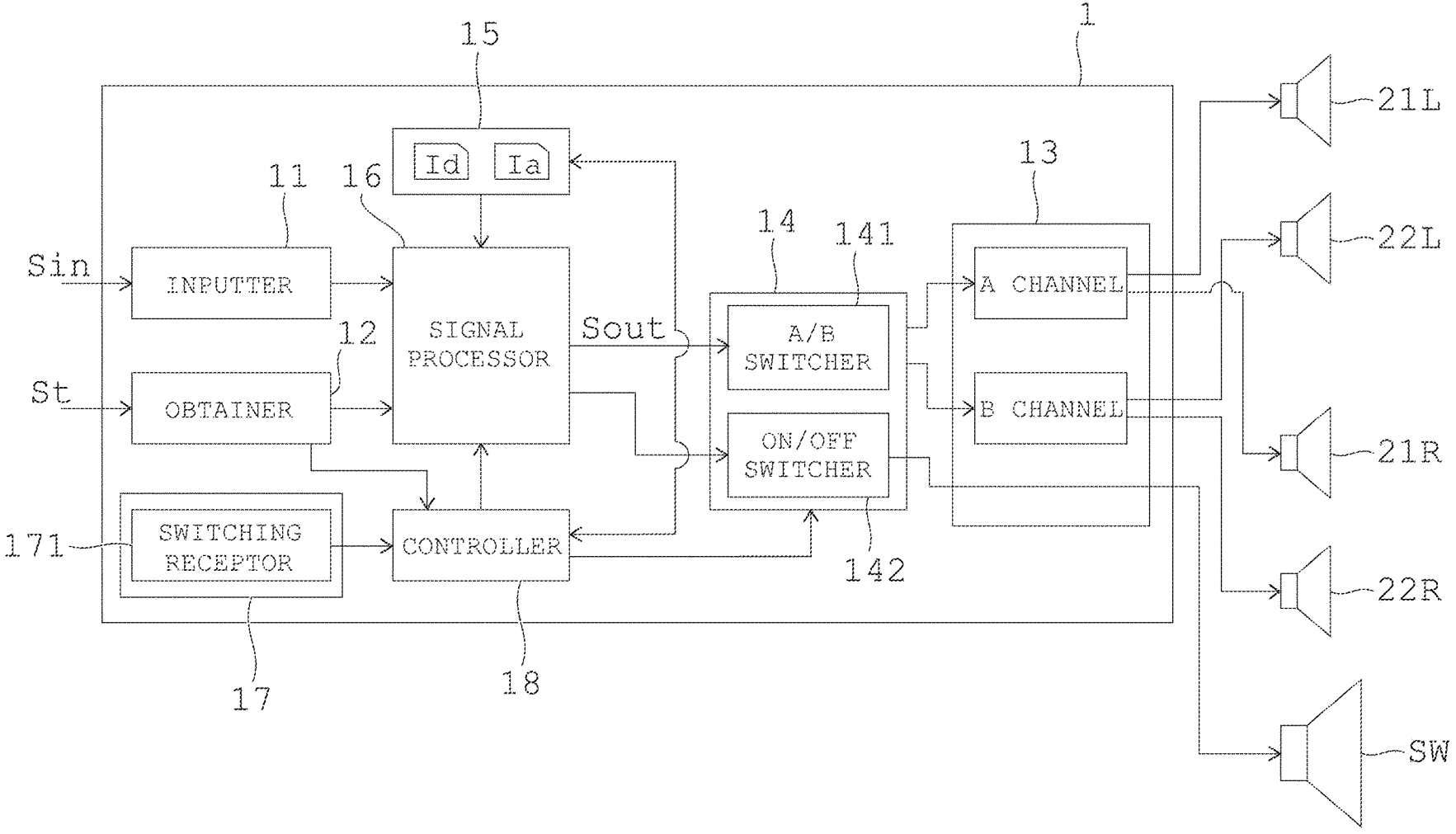
FIG. 6 is a block diagram conceptually showing a configuration of a signal processing device in accordance with a second preferred embodiment.

FIG. 6 is a block diagram conceptually showing a configuration of a signal processing device 1 in accordance with a second preferred embodiment. As shown in FIG. 6, the switching executor 14 may include an AB switcher 141 that performs switching regarding to the A-channel and the B-channel, and an ON/OFF switcher 142 that is connected to a sub-woofer SW and switches between use and non-use of the sub-woofer SW serving as a speaker for super-low pitched sounds.

The switching executor 14 can selectively switch a subject (e.g., only the A-channel, only the B-channel, the A-channel+the B-channel, the A-channel+the SW, the B-channel+the SW, or the A-channel+the B-channel+the SW) to be connected to the signal processor 16 among the A-channel, the B-channel, and the sub-woofer SW. In this case as well, the optimal setting Ia is obtained by measuring characteristics (speaker characteristics) of the speaker selected by the switching, and the obtained optimal setting Ia is stored in the storage 15 associating with the switching of the speaker.

In this signal processing device 1 as well, the characteristics (speaker characteristics) of the speaker selected by the switching can be optimized automatically, according to the switching of the speaker.

[3] Third Preferred Embodiment

The above-mentioned signal processing device 1 is not limited to the signal processing device that processes a two-channel audio signal, but may be a signal processing device that processes a multi-channel audio signal. In this case, speakers corresponding to the number of channels are connected to each of the A-channel and the B-channel.

Figure 7A:
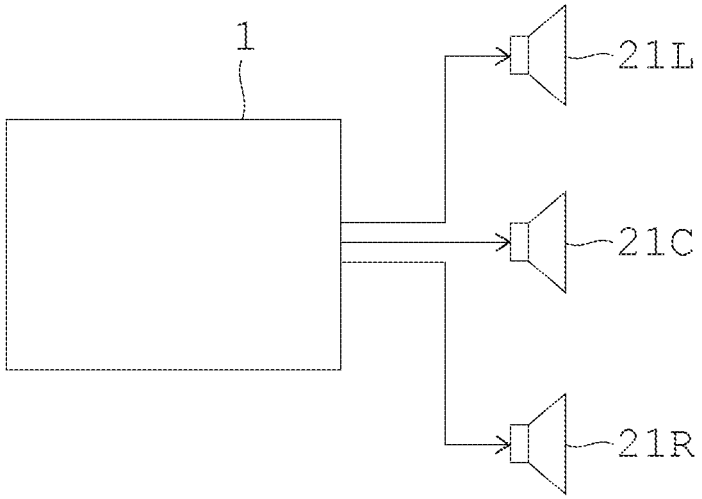
FIGS. 7A and 7B are conceptual diagrams showing a signal processing device in accordance with a third embodiment.
Figure 7B:
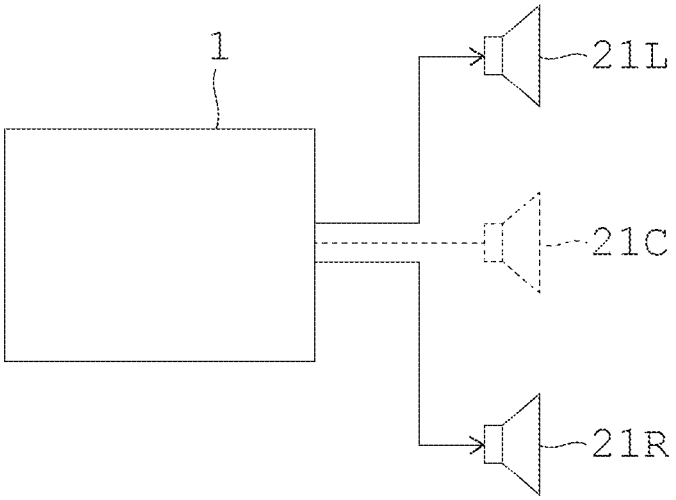

FIG. 7A is a conceptual diagram showing the signal processing device 1 that processes a three-channel audio signal. FIG. 7A shows the case where three speakers 21L, 21R, and 21C are connected to one of output channels of the signal processing device 1. In such a signal processing device 1, switching (this switching includes processing of selecting whether or not to include a signal to be supplied to speaker 21C in the output audio signal Sout outputted from the signal processor 16) between the case (see FIG. 7A) where all three speakers are used and the case (see FIG. 7B) where only two speakers 21L and 21R are used is also included in one aspect of the switching of the speaker in the present invention.

[4] Fourth Preferred Embodiment

Figure 8:
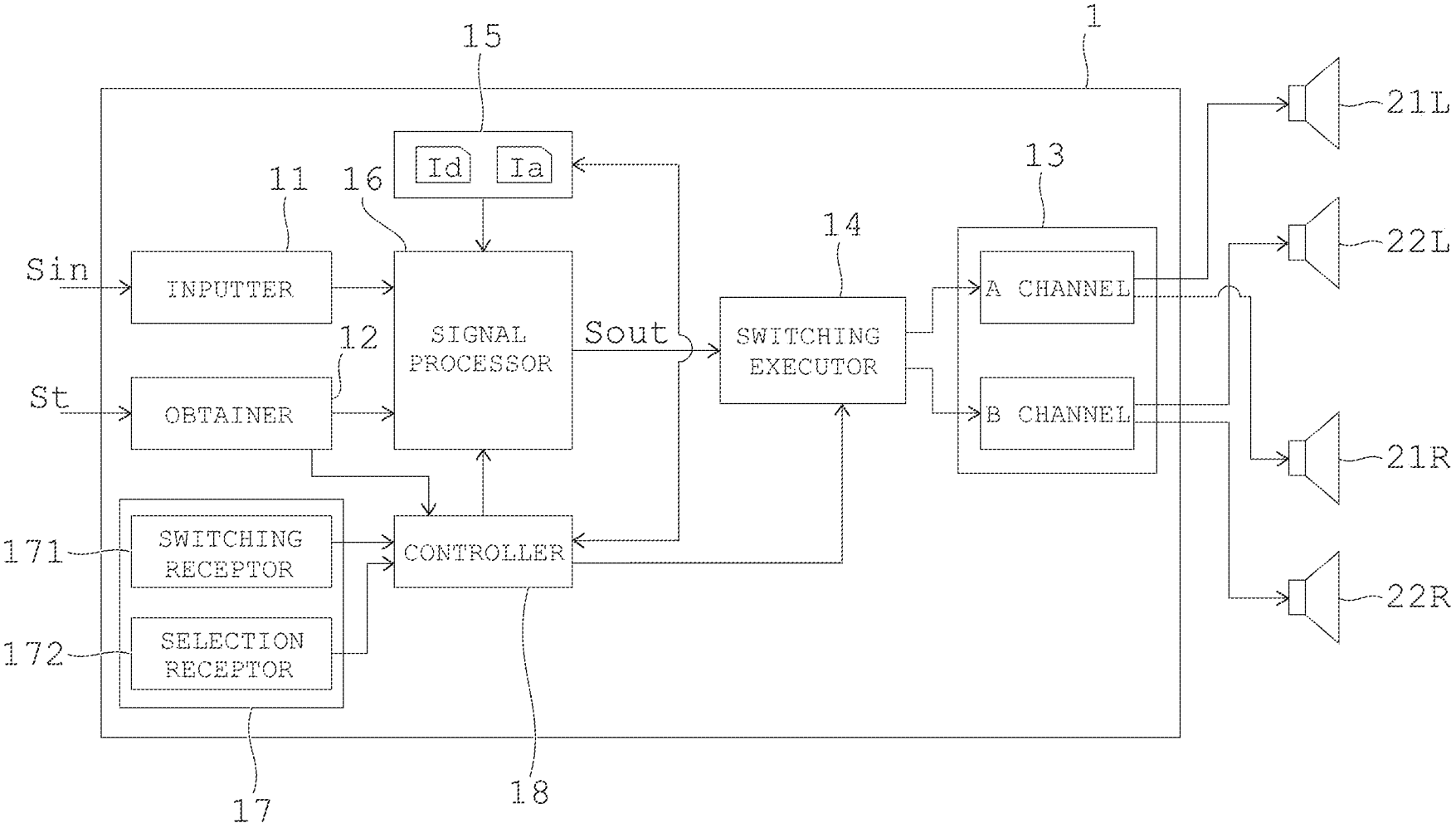
FIG. 8 is a block diagram conceptually showing a configuration of a signal processing device in accordance with a fourth preferred embodiment.

FIG. 8 is a block diagram conceptually showing a configuration of a signal processing device 1 in accordance with a fourth preferred embodiment. As shown in FIG. 8, in the signal processing device 1, the operation receptor 17 may include a selection receptor 172 that receives a selection about whether or not to perform the signal processing using the optimal setting Ia. In other words, the selection receptor 172 receives, from a user, a selection instruction about whether or not to optimize speaker characteristics.

Figure 9:
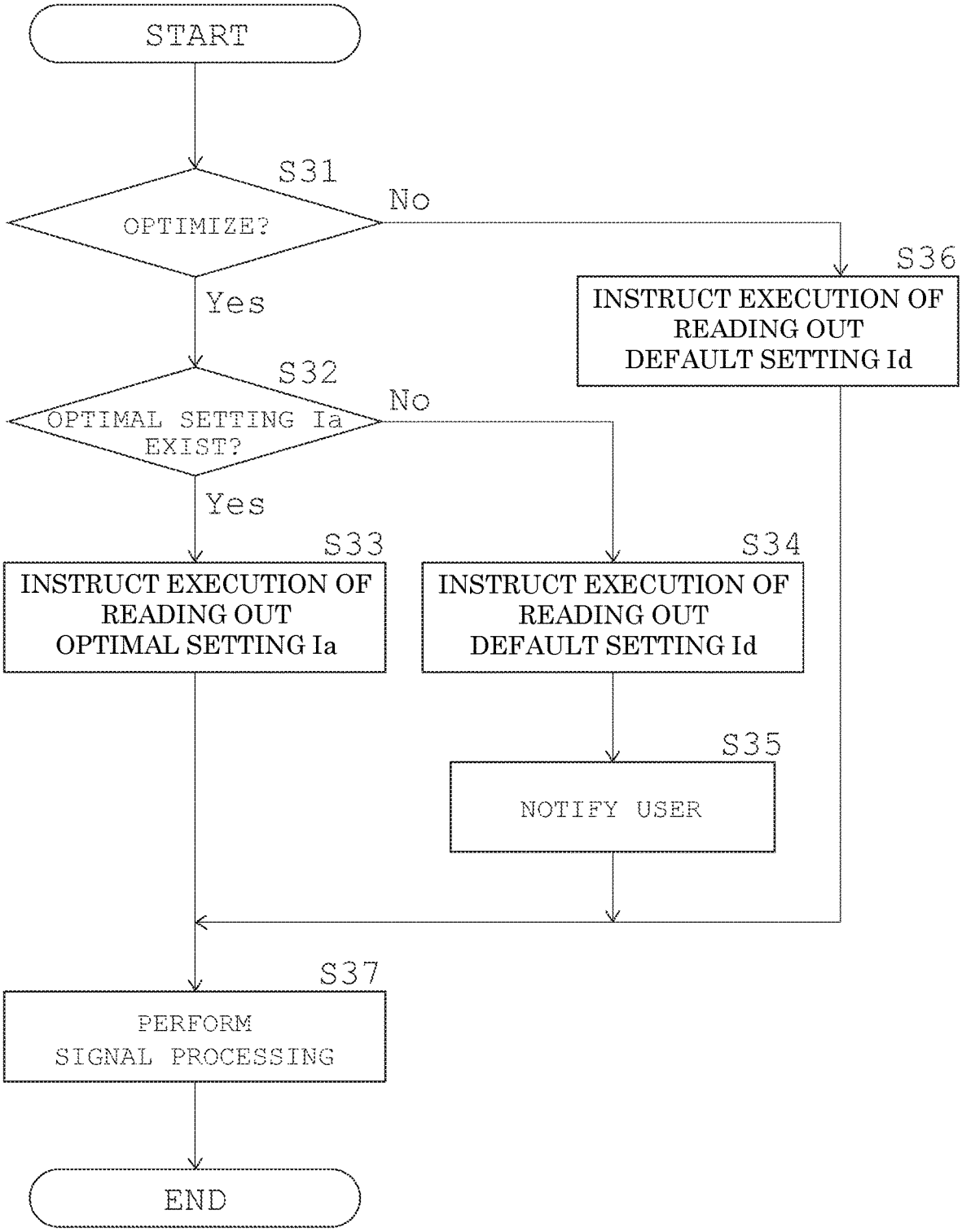
FIG. 9 is a flowchart showing reproduction processing performed in the signal processing device of the fourth preferred embodiment.

FIG. 9 is a flowchart showing reproduction processing performed by the signal processing device 1 in the fourth preferred embodiment. When the reproduction processing is started, the controller 18 determines whether or not to optimize speaker characteristics according to the selection received by the selection receptor 172 (Step S31).

When determining "optimized (Yes)" at Step S31, the controller 18 perform the same processing (Steps S32 to S35, i.e., the processing that causes the signal processor 16 to read the optimal setting Ia) as that of Steps S21 to S24 in FIG. 4. On the other hand, when determining "not optimized (No)" at Step S31, the controller 18 causes the signal processor 16 to read out the default setting Id from the storage 15 (Step S36).

After that, the signal processor 16 performs signal processing of the input audio signal Sin to be inputted (Step S37).

According to the signal processing device 1 of the present preferred embodiment, even after the optimal setting Ia is obtained in the signal processing device 1, it is possible to return to the default setting Id in which no changes have been made, and reproduce sounds. In other words, when sounds are reproduced, a user can select either an output of the optimized sound or an output of the default sound.

[5] Other Preferred Embodiments

In the above-mentioned signal processing device 1, a plurality of output channels, which are not limited to two, may be included in the outputter 13. In such a signal processing device 1, the switching executor 14 may switch a plurality of output channels among various combinations. Further, the signal processing device 1 may have a configuration that sends the output audio signal Sout to the speaker, wirelessly.

The signal processing device 1 may measure speaker characteristics for every speaker or for every output channel. Based on the measurement results, the signal processing device 1 may calculate the speaker characteristics and the optimal setting Ia, which correspond to various combinations of speakers or output channels.

Furthermore, each configuration of the above-mentioned signal processing device 1 is not limited to the configuration that processes an audio signal, but may be applied to a configuration that processes various kinds of sound signals, such as a signal inputted through a microphone.

[6] Another Application Example of Signal Processing Device

Figure 10:
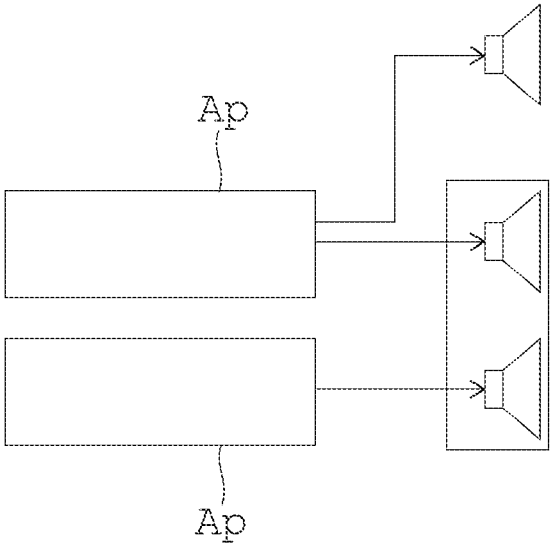
FIG. 10 is a conceptual diagram showing another application example of the signal processing device.

FIG. 10 is a conceptual diagram showing another application example of the signal processing device 1. As shown in FIG. 10, each configuration of the above-mentioned signal processing device 1 is also applicable to bi-amplifiers in which two amplifiers Ap are provided. Note that, each configuration of the signal processing device 1 may be applied to only one of two amplifiers Ap, or may be applied to both of them. Further, with respect to the two amplifiers Ap, switching may be performed between bi-amplifiers and single amplifier. Such switching is also included in one aspect of the switching of the speaker in the present invention.

The description of the above-mentioned preferred embodiment is illustrative in all respects, and should not be construed to be restrictive. The scope of the present invention is indicated by the appended claims rather than by the above-mentioned preferred embodiments. Furthermore, the scope of the present invention is intended to include all modifications within the meaning and range equivalent to the scope of the claims.

What is claimed is:

1. A signal processing device comprising:

a switching receptor that receives an instruction for switching a supply destination of a signal to (i) a first supply destination including a first plurality of speakers, (ii) a second supply destination including a second plurality of speakers different from the first plurality of speakers, or (iii) a third supply destination including a third plurality of speakers including both the first plurality of speakers and the second plurality of speakers;

a storage that stores an optimal setting in association with each of the first supply destination, the second supply destination, and the third supply destination, the optimal setting stored in association with each of the first supply destination, the second supply destination, and the third supply destination being obtained by respectively measuring characteristics of the speakers of the first supply destination, the second supply destination, and the third supply destination; and a signal processor that reads out an optimal setting from among optical settings stored the storage in association with the first supply destination, the second supply destination, and the third supply destination and uses the read-out optimal setting to process a signal to be supplied to the speakers of the first supply destination, the second supply destination, or the third supply destination according to the instruction for switching the supply destination received by the switching receptor.

2. The signal processing device according to claim 1, further comprising a plurality of output channels including a first output channel connected to the first plurality of speakers and a second output channel connected to the second plurality of speakers, wherein the switching received by the switching receptor includes a selection of the first output channel, the second output channel, or both the first output channel and the second output channel.

3. The signal processing device according to claim 2, wherein the first plurality of speakers connected to the first output channel are speakers for high pitched sounds, and the second plurality of speakers connected to the second output channel are speakers for low pitched sounds.

4. The signal processing device according to claim 1, wherein, once an optimal setting associated with the switching allowed to be received by the switching receptor is obtained, the signal processor processes the signal by using the same optimal setting stored in the storage, unless an instruction for changing the optimal setting is received.

5. A signal processing device comprising:

a switching receptor that receives switching of a speaker arranged as a supply destination of a signal;

a storage that stores an optimal setting in association with the switching, the optimal setting being obtained by measuring characteristics of the speaker selected by the switching;

a signal processor that reads out the optimal setting from the storage and uses the optimal setting to process a signal to be supplied to the speaker, the optimal setting being associated with the switching received by the switching receptor; and a selection receptor that receives a selection about whether or not to use the optimal setting in the signal processing, wherein, when the selection receptor receives the selection in which the optimal setting is not used, the signal processor processes the signal by using a default setting.

* * * * *